US005997385A

United States Patent [19]

Nishio

[11] Patent Number: 5,997,385

[45] Date of Patent: Dec. 7, 1999

[54] METHOD AND APPARATUS FOR POLISHING SEMICONDUCTOR SUBSTRATE

[75] Inventor: Mikio Nishio, Osaka, Japan

[73] Assignee: Matsushita Electric Industrial Co., Ltd., Osaka, Japan

[21] Appl. No.: 08/833,180

[22] Filed: Apr. 4, 1997

Related U.S. Application Data

[63] Continuation of application No. 08/692,065, Aug. 7, 1996, Pat. No. 5,769,697.

[30] Foreign Application Priority Data

Aug. 24, 1995 [JP] Japan ..... 7-216262
Dec. 14, 1995 [JP] Japan ..... 7-325319

[51] Int. Cl.[6] ..... B24B 1/00

[52] U.S. Cl. ..... 451/56; 451/45; 451/443; 451/288

[58] Field of Search ..... 451/41, 56, 285–289, 451/443

[56] References Cited

U.S. PATENT DOCUMENTS 5,486,131 1/1996 Cesna et al. ..... 451/443
5,547,417 8/1996 Breivogel et al. ..... 451/443

*Primary Examiner*—David A. Scherbel
*Assistant Examiner*—George Nguyen
*Attorney, Agent, or Firm*—McDermott, Will & Emery

[57] ABSTRACT

An elastic polishing pad is adhered to a surface of a flat substrate holder of a platen. A substrate holding head which holds and rotates a semiconductor substrate is provided above a first region extending from the central portion to peripheral portion of the polishing pad. The semiconductor substrate rotated by the substrate holding head is pressed against the first region of the polishing pad. A slurry is dropped in a prescribed amount from an abrasive supply pipe onto the polishing pad. Pad pressing means for pressing the polishing pad is provided above a second region extending from the central portion to peripheral portion of the platen. The pad pressing means has a disk-shaped pad pressing plate and a rotary shaft for holding the pad pressing plate.

2 Claims, 11 Drawing Sheets

METHOD AND APPARATUS FOR POLISHING SEMICONDUCTOR SUBSTRATE

This is a continuation application of Ser. No. 08/692,065, filed Aug. 7, 1996, now U.S. Pat. No. 5,769,697.

BACKGROUND OF THE INVENTION

The present invention relates to a method and apparatus for polishing a semiconductor substrate whereby chemical mechanical polishing (CMP) is performed with respect to a semiconductor substrate of silicon or the like to flatten a surface thereof.

From the 1990s, CMP technology for polishing semiconductor substrates of silicon or the like has shown increasing tendencies toward single-wafer processing as the semiconductor substrates processed by CMP have had larger diameters on the order of 10 cm or more. Since design rules of 0.5 $\mu$m or less have been used to form an extremely small pattern on a semiconductor substrate, equal polishing should be performed with respect to the entire surface thereof.

Below, a method and apparatus for polishing a semiconductor substrate according to a first conventional embodiment will be described with reference to the drawings.

FIG. 8 schematically shows the construction of the apparatus for polishing a semiconductor substrate according to the first conventional embodiment, in which is shown a platen 21 including: a substrate holder 21*a* made of a rigid material and having a flat surface; a rotary shaft 21*b* extending vertically downwardly from the back face of the above substrate holder 21*a*; and rotating means (not shown) for rotating the above rotary shaft 21*b*. To the top surface of the substrate holder 21*a* of the platen 21 is adhered an elastic polishing pad 22. Above the polishing pad 22 is provided a substrate holding head 24 which holds and rotates a semiconductor substrate 23. The semiconductor substrate 23 is rotated and pressed against a first region of the polishing pad 22 by the substrate holding head 24. A slurry 25 in a prescribed amount is supplied dropwise from an abrasive supply pipe 26 onto the polishing pad 22.

In the apparatus for polishing a semiconductor substrate thus constructed, the polishing pad 22 supplied with the slurry 25 is rotated by rotating the platen 21 and the semiconductor substrate 23 is pressed against the rotating polishing pad 22 by the substrate holding head 24 so that a surface of the semiconductor substrate 23 is polished under pressure at a relative speed.

In this process, if the surface of the semiconductor substrate 23 is rugged, the polishing rate is increased at projecting portions of the semiconductor substrate 23 since their contact pressure with the polishing pad 22 is high. On the other hand, the polishing rate is reduced at recessed portions of the semiconductor substrate 23 since their contact pressure with the polishing pad 22 is low. Consequently, the surface of the semiconductor substrate 23 becomes less rugged and more smooth.

However, the above method and apparatus for polishing a semiconductor substrate according to the first conventional embodiment present the following problems, which will be described with reference to FIGS. 9 to 11.

FIG. 9(*a*) qualitatively shows a relationship between the pressing period for the polishing pad 22 and the thickness of the polishing pad 22. In FIG. 9(*a*), the vertical axis represents the thickness of the polishing pad and the horizontal axis represents the pressing period for the polishing pad, which is the time elapsed since the initiation of polishing.

FIG. 9(*b*) qualitatively shows the thickness of the polishing pad recovering with time after it is pressed under a given pressure subsequently reduced to 0. In FIG. 9(*b*), the vertical axis represents the thickness of the polishing pad and the horizontal axis represents the time elapsed since the pressure is reduced to 0 after pressing.

FIG. 10 is a schematic plan view illustrating different pressing periods for the polishing pad 22 depending on different radial positions of the polishing pad 22. FIG. 11 is a schematic cross-sectional view showing the construction of the platen 21 during polishing, which is taken along the diameter of the platen 21 (along the line VI—VI of FIG. 10).

When a commonly-used elastic material, such as one containing non-woven fabric or urethane foam as the main component, is used to compose the polishing pad 22, the amount of elastic deformation at the moment at which the polishing pad 22 initiates receiving pressure (within several seconds) differs depending on the time elapsed since the initiation of pressing, as shown in FIG. 9(*a*). When the polishing pad 22 is released from the pressure, the amount of elastic deformation is gradually reduced with the passage of time, as shown in FIG. 9(*b*).

According to the polishing method of the first conventional embodiment shown in FIG. 8, the period during which the polishing pad 22 is in contact with the semiconductor substrate 23 (i.e., the period during which the polishing pad 22 is pressed) varies. Specifically, the period during which the polishing pad 22 is in contact with and pressed by the semiconductor substrate 23 is different at the position a corresponding to the radius r1, at the position b corresponding to the radius r2, and at the position c corresponding to the radius r3 shown in FIG. 10. The period during which the polishing pad 22 is not pressed (the period for elastic deformation) is also different at the positions a, b, and c shown in FIG. 10. Consequently, on the polishing pad 22 in contact with the semiconductor substrate 23, the amount of elastic deformation of the polishing pad 22 is larger at the position b corresponding to the radius r2 substantially passing through the center of the semiconductor substrate 23 where the pressing period is relatively long and the recovering period is relatively short, while the amount of elastic deformation of the polishing pad 22 is smaller at the respective positions a and b corresponding to the radii r1 and r3 where the pressing period is relatively short and the recovering period is relatively long.

Accordingly, the thickness of the polishing pad 22 is smaller at the radially middle portion thereof (position b) and larger at the radially inner and outer portions thereof (positions a and c) when viewed in a cross section taken along a radius of the polishing pad 22 as shown in FIG. 11.

If such a polishing pad 22 is used to polish a flat semiconductor substrate 23 in contact with and pressed by the polishing pad 22, the polishing pad 22 exerts a higher pressure on the radially inner and outer portions of the polishing pad 22, while exerting a lower pressure on the radially middle portion of the polishing pad 22. A difference in pressure on the surface of the polishing pad 22 corresponds to a difference in polishing rate so that the polishing rate at the radially middle portion of the polishing pad 22 is lower than the polishing rate at the radially inner and outer portions of the polishing pad 22. Hence, it is impossible to equally polish the entire surface of the semiconductor substrate 23.

To overcome the problem, there has been proposed a technique utilizing the deformation of a semiconductor substrate 33 against the elastic deformation of the polishing pad 32, as shown in FIG. 12.

The following is the description of a method and apparatus for polishing a semiconductor substrate according to a second conventional embodiment. To a platen 31 is adhered an elastic polishing pad 32. The lower portion of a substrate holding head 34 for holding a semiconductor substrate 33 is provided with an airtight space 37 defined by a head main body 35 having a recessed portion and a plate-like elastic member 36 which can be elastically deformed and is provided in the recessed portion of the head main body 35. A gas under controlled pressure is introduced from a gas supply path 38 into the airtight space 37. Thus, by using the gas under pressure introduced into the airtight space 37 to press the semiconductor substrate 33 against the polishing pad 32 with intervention of the elastic member 36, equal polishing is performed by evenly pressing the semiconductor substrate 33 from the back face thereof.

However, in the case where there is a difference in the thickness or in the amount of elastic deformation of the polishing pad 32, the semiconductor substrate 33 is deformed (warped) to follow the rugged configuration of the surface of the polishing pad 32. As a result, a pressure difference is produced due to a force (pressure) required for the deformation of the semiconductor substrate 33, resulting in uneven pressing. Consequently, the problem of the semiconductor substrate 33 pressed unevenly remains unsolved.

SUMMARY OF THE INVENTION

In view of the foregoing, it is therefore an object of the present invention to equally polish a surface of a semiconductor substrate by means of an elastic polishing pad.

To attain the above object, an apparatus for polishing a semiconductor substrate according to the present invention comprises: a platen having a flat surface conducting a two-dimensional movement; an elastic polishing pad disposed on the flat surface of the platen; substrate holding means for holding and rotating a semiconductor substrate to be polished, while pressing the semiconductor substrate against a circular first region of the polishing pad; abrasive supply means for supplying a slurry onto the polishing pad; and pad pressing means having a pad pressing tool for pressing a second region of the polishing pad to cause elastic deformation thereof.

In the apparatus for polishing a semiconductor substrate according to the present invention, the pad pressing tool can press the polishing pad to cause elastic deformation thereof even when polishing is not performed and the semiconductor substrate is not pressing the first region of the polishing pad. Since the polishing pad elastically deformed by the pad pressing tool recovers slowly, it has not recovered completely upon reaching the semiconductor substrate, so that the amount of deformation of the polishing pad is small when the polishing pad is pressed by the semiconductor substrate under polishing. Although the first region of the polishing pad is circular and hence the semiconductor substrate presses the region of the polishing pad in contact with the peripheral portion of the semiconductor substrate for a shorter period of time than the region of the polishing pad in contact with the central portion of the semiconductor substrate, a difference in thickness produced in the polishing pad can be reduced since the amount of deformation of the polishing pad caused under the pressure exerted by the semiconductor substrate is small. As a result, the polishing pad retains its flatness and the pressure received by the semiconductor substrate from the polishing pad during polishing becomes substantially equal over the entire surface of the semiconductor substrate, which enables remarkably equal polishing.

The two-dimensional movement may be a rotary movement or a linear movement.

Preferably, the pad pressing tool has a flat and smooth pressing surface. With the arrangement, the polishing pad is not damaged when pressed by the pad pressing tool, so that damage caused by the polishing pad to the semiconductor substrate is prevented.

Preferably, the pad pressing tool is formed from resin. With the arrangement, the pad pressing tool is resistant to erosion induced by the polishing pad, so that steady operation is performed.

If the pad pressing tool has a circular pressing surface, it can be fabricated easily.

Preferably, the pad pressing tool has an annular pressing surface. With the arrangement, the semiconductor substrate exerts more pressure on the region of the polishing pad in contact with the peripheral portion of the semiconductor substrate than on the region of the polishing pad in contact with the central portion of the semiconductor substrate. Accordingly, the sum of the pressure received by the polishing pad from the pad pressing tool and the pressure received by the polishing pad from the semiconductor substrate is substantially equal in any region of the polishing pad. Consequently, the entire region of the polishing pad in contact with the semiconductor substrate is elastically deformed substantially uniformly, so that more equal polishing is performed with respect to the semiconductor substrate.

When the two-dimensional movement is a rotary movement, the center of the pressing surface of the pad pressing tool and the center of the first region are preferably positioned on a concentric circle centering around the center of a rotary movement of the platen. With the arrangement, the region of the polishing pad pressed by the semiconductor substrate was pressed positively by the pad pressing tool and in a recovering process from elastic deformation, so that the polishing pad retains its flatness more successfully. Consequently, the pressure received by the semiconductor substrate from the polishing pad during polishing becomes more equal over the entire surface of the substrate, resulting in more equal polishing.

In this case, a diameter of the pressing surface of the pad pressing tool is preferably larger than a diameter of the first region. With the arrangement, the region of the polishing pad pressed by the semiconductor substrate is more positively pressed by the pad pressing tool, so that more equal polishing is performed with respect to the semiconductor substrate.

Preferably, the pad pressing tool has a trapezoidal pressing surface gradually widened from the center of a rotary movement of the platen toward the outside thereof. With the arrangement, a significant time difference is not produced between the period during which the pad pressing tool presses the inner part of the region of the polishing pad pressed by the pad pressing tool and the period during which the pad pressing tool presses the outer part of the region of the polishing pad pressed by the pad pressing tool. Consequently, the amount of elastic deformation caused in the polishing pad by the pad pressing tool becomes substantially equal, which enables more equal polishing with respect to the semiconductor substrate.

Preferably, the second region is substantially the entire region of a polishing surface of the polishing pad except for the first region. With the arrangement, the entire surface of the polishing pad constantly pressed by the semiconductor substrate and pad pressing tool retains a specified amount of elastic deformation, which enables more equal polishing with respect to the semiconductor substrate.

Preferably, a pressing surface of the pad pressing tool is formed with a groove for supplying the slurry to a polishing surface of the polishing pad. With the arrangement, the region of the polishing surface of the polishing pad in contact with the pressing surface of the pad pressing tool receives the slurry newly supplied from the groove, so that the degraded slurry remaining on the polishing pad is replaced thereby.

Preferably, the pad pressing tool is composed of a roller having a rotary shaft substantially in parallel with the flat surface of the platen, the roller being pressed against the second region of the polishing pad and rotating in conjunction with the movement of the platen. With the arrangement, the pad pressing tool can press the polishing pad with reduced friction generated between the polishing pad and the pad pressing tool, so that more steady polishing is performed. In this case, the second region is preferably larger than the first region.

When the two-dimensional movement is a rotary movement, the roller is preferably in the form of a truncated cone in which a relative proportion of radii in respective transverse cross sections of the roller is equal to a relative proportion of distances between the center of rotation of the polishing pad and respective positions on the polishing pad in contact with the respective transverse cross sections of the roller. With the arrangement, the roller conducts a rotary movement at the same speed as the rotation speed of the platen, so that no friction is generated when the roller presses the polishing pad.

When the two-dimensional movement is a rotary movement or a linear movement, the roller is preferably cylindrical. With the arrangement, the pad pressing tool can be fabricated easily.

Preferably, the roller is composed of a plurality of roller members disposed on a single shaft. With the arrangement, the amount of generated friction can be reduced even when the speeds at the roller members in contact with the polishing pad are different, so that more steady polishing is performed.

Preferably, the roller presses the vicinity of a region of the polishing pad in contact with the semiconductor substrate for a relatively short period of time. With the arrangement, the roller can press the region of the polishing pad with a reduced amount of elastic deformation, so that polishing is performed with improved uniformity.

A method of polishing a semiconductor substrate according to the present invention comprises: an abrasive supplying step of supplying a slurry onto an elastic polishing pad disposed on a flat surface of a platen conducting a two-dimensional movement; a substrate polishing step of polishing a semiconductor substrate by pressing the semiconductor substrate onto a circular first region of the polishing pad; and a pad pressing step of pressing a second region of the polishing pad to elastically deform the second region.

By the method of polishing a semiconductor substrate according to the present invention, the pad pressing tool can press the polishing pad to cause elastic deformation thereof and the polishing pad elastically deformed by the pad pressing tool slowly recovers, similarly to the apparatus for polishing a semiconductor substrate according to the present invention, so that the polishing pad undergoes a small amount of deformation when pressed by the semiconductor substrate under polishing. Consequently, the polishing pad retains its flatness and the pressure received by the semiconductor substrate from the polishing pad during polishing becomes uniform over the entire surface of the semiconductor substrate, which enables remarkably equal polishing.

Preferably, a pressure for pressing the second region of the polishing pad in the pad pressing step is equal to or higher than a pressure for pressing the first region of the polishing pad in the substrate polishing step. With the arrangement, the entire region of the polishing pad, particularly the region of the polishing pad in contact with the peripheral portion of the semiconductor substrate, is pressed satisfactorily, so that the entire region of the polishing pad in contact with the semiconductor substrate is elastically deformed substantially uniformly. As a result, the surface of the polishing pad in contact with the semiconductor substrate is positively flattened and the semiconductor substrate is polished by the polishing pad under uniform pressure, which enables more equal polishing.

The two-dimensional movement may be a rotary movement or a linear movement.

DETAILED DESCRIPTION OF THE INVENTION

Apparatus and methods for polishing a semiconductor substrate according to the respective embodiments of the present invention will now be described with reference to the drawings.

First Embodiment

Figure 1:
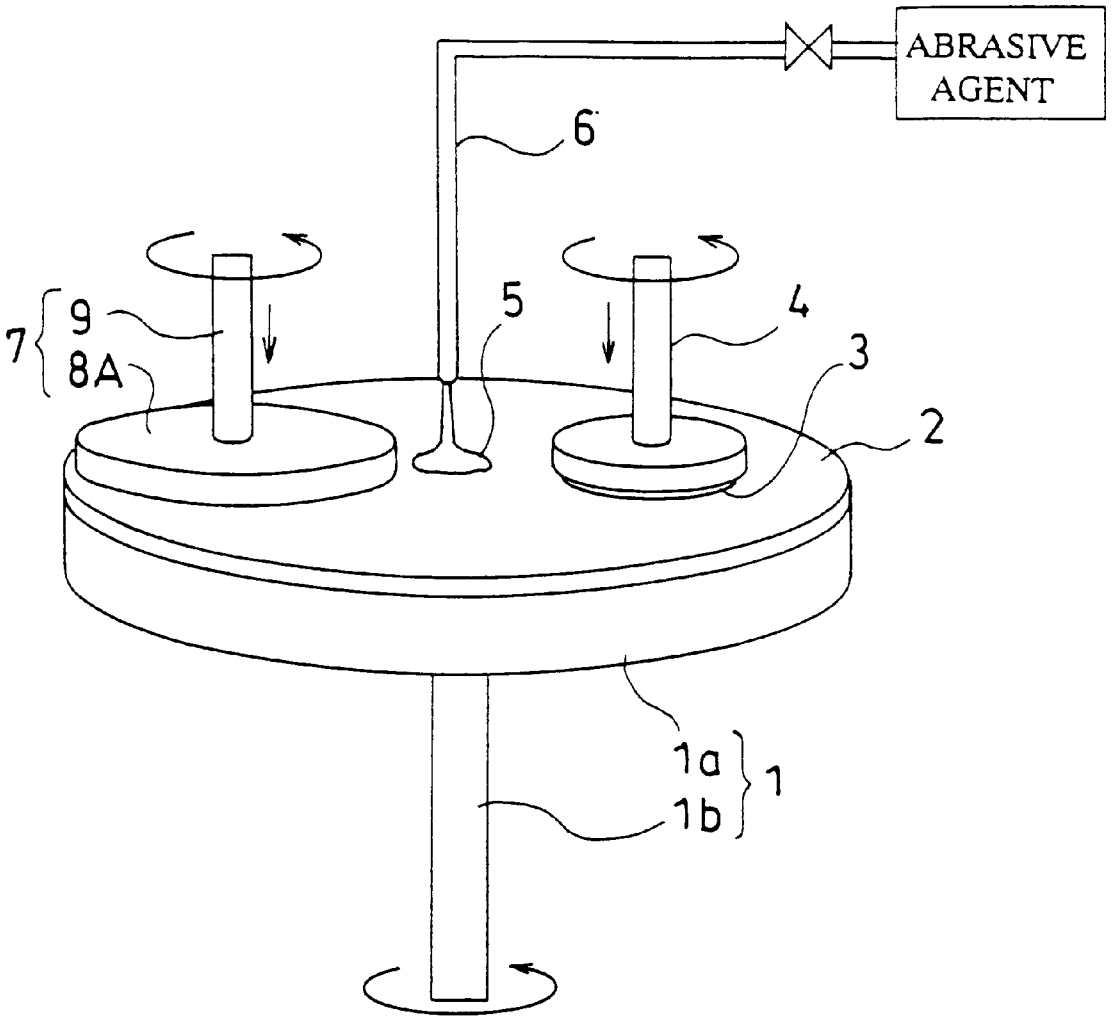
FIG. 1 is a schematic perspective view of an apparatus for polishing a semiconductor substrate according to a first embodiment of the present invention.
Figure 2A:
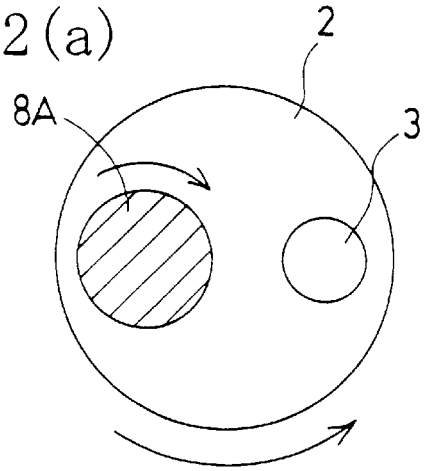
FIGS. 2(*a*) to 2(*e*) are plan views showing the respective configurations of pad pressing tools in apparatus for polishing a semiconductor substrate according to first to fifth embodiments of the present invention.
Figure 2C:
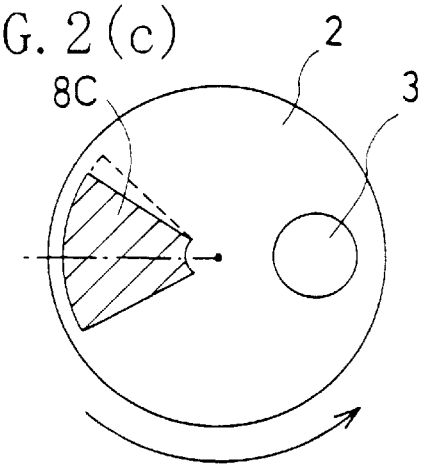
Figure 2B:
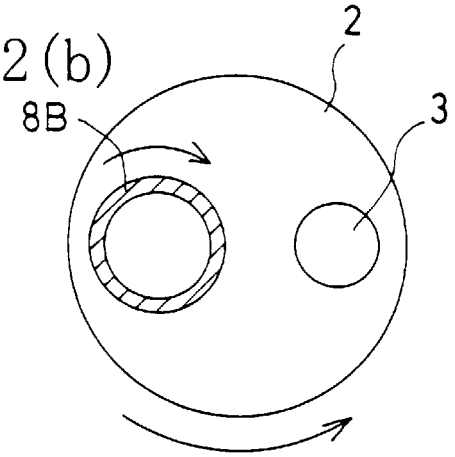
Figure 2D:
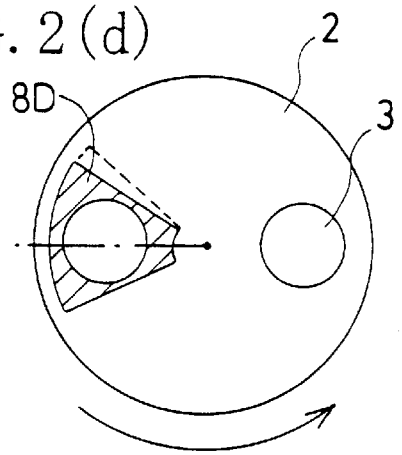
Figure 2E:
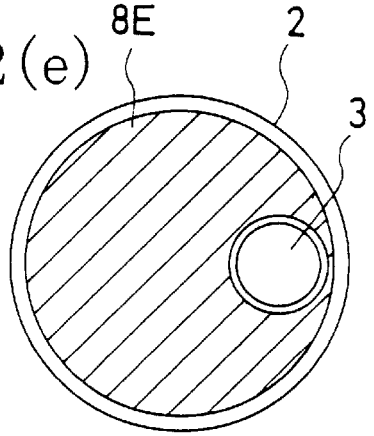

FIG. 1 is a schematic view illustrating the construction of an apparatus for polishing a semiconductor substrate according to a first embodiment of the present invention, in which is shown a platen 1 including: a substrate holder 1*a* made of a rigid material and having a flat surface; a rotary shaft 1*b* extending vertically downwardly from the back face of the above substrate holder 1*a*; and rotating means (not shown) for rotating the above rotary shaft 1*b*. To the top surface of the substrate holder 1*a* of the above platen 1 is adhered an elastic polishing pad 2. Above a circular first region extending from the central portion to peripheral portion of the platen 1, there is provided a substrate holding head 4 which holds and rotates a semiconductor substrate 3. The semiconductor substrate 3 is rotated and pressed against the first region of the polishing pad 2 by the substrate holding head 4. A slurry 5 is dropped in a prescribed amount from an abrasive supply pipe 6 onto the polishing pad 2 to be supplied to the space between the polishing pad 2 and the semiconductor substrate 3.

The first embodiment is characterized in that pad pressing means 7 for pressing a second region of the polishing pad 2 is provided above the second region extending from the central portion to peripheral portion of the platen 1. The pad pressing means 7 consists of a disk-shaped pad pressing plate 8A and a rotary shaft 9 for holding the pad pressing plate 8A.

Below, a description will be given to the operation of the polishing apparatus according to the first embodiment.

First, the slurry 5 containing abrasive grains is quantitively dropped from the abrasive supply pipe 6 onto the rotating polishing pad 2 so that the polishing pad 5 is spread by the rotation of the platen 1 over the entire surface of the polishing pad 2.

Then, the substrate holding head 4 holding the semiconductor substrate 3 and the pad pressing means 7 are individually rotated and lowered such that the semiconductor substrate 3 and the pad pressing plate 8A are pressed against the polishing pad 2.

As a result, the first region of the elastic polishing pad 2 is pressed by the pad pressing plate 8A and depressed to a specified depth due to elastic deformation. Since the platen 1 is rotating, the first region of the polishing pad 2 depressed to the specified depth instantaneously reaches the semiconductor substrate 3 while recovering from elastic deformation.

The polishing pad 2 composed of a commonly-used material containing non-woven fabric or urethane foam as the main component recovers from elastic deformation at an extremely low speed compared with the speed at which it is elastically deformed under pressure. As long as the platen 1 is rotated at a comparatively high speed (e.g., 30 rpm or more), the amount of deformation of the polishing pad 2 remains substantially the same even after it is brought in contact with and pressed by the semiconductor substrate 3, since the polishing pad 2 has not completely recovered from elastic deformation even at the time at which the region of the polishing pad 2 compressed by the pad pressing plate 8A reaches the semiconductor substrate 3. Consequently, the second region of the polishing pad 2 compressed by the pad pressing plate 8A is still deformed when it slides over the semiconductor substrate 3.

By adjusting the amount of deformation of the polishing pad 2 at the time at which the polishing pad 2 elastically deformed by the pad pressing plate 8A reaches the semiconductor substrate 3 to a value substantially equal to the amount of deformation caused under the pressure (=the pressure exerted by the semiconductor substrate 3) during polishing, the polishing pad 2 is hardly deformed upon receiving the pressure from the semiconductor substrate 3.

FIG. 2(*a*) shows the plan configuration of the pad pressing plate 8A and the position thereof relative to the polishing pad 2 in the first embodiment. The center of the disk-shaped pad pressing plate 8A and the center of the semiconductor substrate 3 are equidistant from the center of the polishing pad 2. The diameter of the pad pressing plate 8A is sufficiently larger than the diameter of the semiconductor substrate 3.

When the polishing pad 2 is pressed by means of the pad pressing plate 8A according to the first embodiment, the entire region of the polishing pad 2 in contact with the semiconductor substrate 3 is in a recovering process from elastic deformation at the time at which the polishing pad 2 reaches the semiconductor substrate 3, so that the entire region of the polishing pad 2 in contact with the semiconductor substrate 3 is still elastically deformed, which permits equal polishing with respect to the semiconductor substrate 3.

In this case, if a pressure equal to or higher than the pressure received from the semiconductor substrate 3 under polishing is exerted on the polishing pad 2 by means of the pad pressing plate 8A according to the first embodiment, the region of the polishing pad 2 in contact with the peripheral portion of the semiconductor substrate 3 is pressed satisfactorily and the entire region of the polishing pad 2 in contact with the semiconductor substrate 3 is elastically deformed substantially uniformly so that the region of the polishing pad 2 in contact with the peripheral portion of the semiconductor substrate 3 is also pressed satisfactorily. As a result, the entire region of the polishing pad 2 in contact with the semiconductor substrate 3 is elastically deformed substantially uniformly and the surface of the polishing pad 2 in contact with the semiconductor substrate 3 is flattened. Accordingly, the polishing pad 2 polishes the semiconductor substrate 3 under uniform pressure, resulting in equal polishing with respect to the semiconductor substrate 3.

In the first embodiment, the pad pressing plate 8A may be rotated or may not be rotated. In the case of rotating the pad pressing plate 8A, the pad pressing plate 8A may be rotated in the same direction as the platen 1 (polishing pad 2) is rotated as shown in FIG. 1 or in the direction opposite to the rotation of the platen 1 (polishing pad 2) as shown in FIG. 2(*a*). If the pad pressing plate 8A is rotated in the direction opposite to the rotation of the platen 1, the slurry 5 supplied onto the polishing pad 2 is directed toward the outside of the polishing pad 2 by a centrifugal force accompanying the rotation of the polishing pad 2 but, upon reaching the pad pressing plate 8A on the way to the outside, the slurry 5 is returned by the rotation of the pad pressing plate 8A to the center of the polishing pad 2 for reuse in the polishing of the semiconductor substrate 3. Accordingly, the use of the slurry 5 can be reduced.

Second Embodiment

FIG. 2(*b*) shows the configuration of a pad pressing plate 8B of a polishing apparatus according to a second embodiment. In the second embodiment, the pad pressing plate 8B is annular. The center of the pad pressing plate 8B and the center of the semiconductor substrate 3 are equidistant from the center of the polishing pad 2. The inner diameter of the pad pressing plate 8B is slightly larger than the diameter of the semiconductor substrate 3.

If a pressure equal to or higher than the pressure received from the semiconductor substrate 3 under polishing is exerted on the polishing pad 2 by the pad pressing plate 8B according to the second embodiment, the region of the polishing pad 2 in contact with the peripheral portion of the semiconductor substrate 3 receives a pressure higher than the pressure received by the region of the polishing pad 2 in contact with the central portion of the semiconductor substrate 3, so that the sum of the pressure exerted by the pad pressing plate 8B on the polishing pad 2 and the pressure exerted by the semiconductor substrate 3 becomes substantially equal in any region of the polishing pad 2. Consequently, the entire region of the polishing pad 2 in contact with the semiconductor substrate 3 is elastically deformed substantially uniformly, which permits equal polishing with respect to the semiconductor substrate 3.

In the second embodiment also, the pad pressing plate 8B may be rotated or may not be rotated. In the case of rotating the pad pressing plate 8B, it may be rotated in the same direction as the platen 1 (polishing pad 2) is rotated or in the direction opposite to the rotation of the platen 1 (polishing pad 2) as shown in FIG. 2(*b*). If the pad pressing plate 8B is rotated in the direction opposite to the rotation of the platen 1, the slurry 5 supplied onto the polishing pad 2 reaches the pad pressing plate 8B on the way to the outside of the polishing pad 2 and is returned by the rotation of the pad pressing plate 8B to the center of the polishing pad 2 for reuse in the polishing of the semiconductor substrate 3, similarly to the first embodiment.

Third Embodiment

FIG. 2(*c*) shows the configuration of a pad pressing plate 8C of a polishing apparatus according to a third embodiment. In the third embodiment, the pad pressing plate 8C represented by the solid line in FIG. 2(*c*) is in the form of a truncated sector which is symmetrical with respect to the center line represented by the dash-dot line. The center of the pad pressing plate 8C in the form of a truncated sector is coincident with the center of the polishing pad 2.

If a pressure equal to or higher than the pressure received from the semiconductor substrate 3 under polishing is exerted on the polishing pad 2 by means of the pad pressing plate 8C according to the third embodiment, a region along a given circular arc passing through any point on the dash-dot line is pressed by the pad pressing plate 8C for an equal period of time, so that the pad pressing plate 8C causes an equal amount of deformation in the region along the given circular arc of the polishing pad 2. Consequently, the amount of deformation of the polishing pad 2 on reaching the semiconductor substrate 3 becomes substantially equal to the amount of deformation caused by the semiconductor substrate 3. Hence, the polishing pad 2 is not deformed during polishing, which enables more equal polishing with respect to the semiconductor substrate 3.

As represented by the solid line of FIG. 2(*c*), the pad pressing plate 8C may have a symmetrical configuration with respect to the center line represented by the dash-dot line or alternatively an asymmetrical configuration in which the joint between the outer circular arc and one of the two radii to which the slurry 5 is directed during the rotation of the polishing pad 2 is positioned downstream of the joint of the inner circular arc and the radius in the direction of rotation of the polishing pad 2, as represented by the broken line of FIG. 2(*c*). With the pad pressing plate 8C thus asymmetrically configured, the slurry 5 supplied onto the polishing pad 2 is directed toward the outside of the polishing pad 2 by a centrifugal force accompanying the rotation of the polishing pad 2 but, upon reaching the radial side edge of the pad pressing plate 8C, the slurry 5 is returned to the center of the polishing pad 2 for reuse in the polishing of the semiconductor substrate 3.

Fourth Embodiment

FIG. 2(*d*) shows the configuration of a pad pressing plate 8D of a polishing apparatus according to a fourth embodiment. In the fourth embodiment, the pad pressing plate 8D presents a configuration obtained by cutting out a circular portion corresponding to the semiconductor substrate 3 from the sector of the third embodiment.

If a pressure equal to or higher than the pressure received from the semiconductor substrate 3 under polishing is exerted on the polishing pad 2 by means of the pad pressing plate 8D according to the fourth embodiment, the sum of the pressure exerted by the pad pressing plate 8D on the region along a circular arc passing through any point on the dash-dot line of the polishing pad 2 and the pressure exerted by the semiconductor substrate 3 becomes equal in any region of the polishing pad 2. Consequently, the entire region of the polishing pad 2 in contact with the semiconductor substrate 3 is elastically deformed substantially uniformly, which enables more equal polishing with respect to the semiconductor substrate 3.

As represented by the solid line of FIG. 2(*d*), the pad pressing plate 8D may have a symmetrical configuration with respect to the center line represented by the dash-dot line or alternatively an asymmetrical configuration in which the joint between the outer circular arc and one of the two radii to which the slurry 5 is directed during the rotation of the polishing pad 2 is positioned downstream of the joint of the inner circular arc and the radius in the direction of rotation of the polishing pad 2, as represented by the broken line of FIG. 2(*d*). With the pad pressing plate 8D thus asymmetrically configured, the slurry 5 supplied onto the polishing pad 2 is directed toward the outside of the polishing pad 2 by a centrifugal force accompanying the rotation of the polishing pad 2 but, upon reaching the radial side edge of the pad pressing plate 8D, the slurry 5 is returned to the center of the polishing pad 2 for reuse in the polishing of the semiconductor substrate 3.

Fifth Embodiment

FIG. 2(*e*) shows the configuration of a pad pressing plate 8E of a polishing pad according to a fifth embodiment. In the fifth embodiment, the pad pressing plate 8E presents a configuration obtained by cutting out a circular portion slightly larger in diameter than the semiconductor substrate 3 from a circular portion slightly smaller in diameter than the polishing pad 2.

If a pressure equal to the pressure received from the semiconductor substrate 3 under polishing is exerted on the polishing pad 2 by means of the pad pressing plate 8E according to the fifth embodiment, the entire surface of the polishing pad 2 is pressed under the pressure during polishing, so that the entire surface of the polishing pad 2 constantly retains a specified amount of deformation, which enables more equal polishing with respect to the semiconductor substrate 3.

Sixth Embodiment

Figure 3:
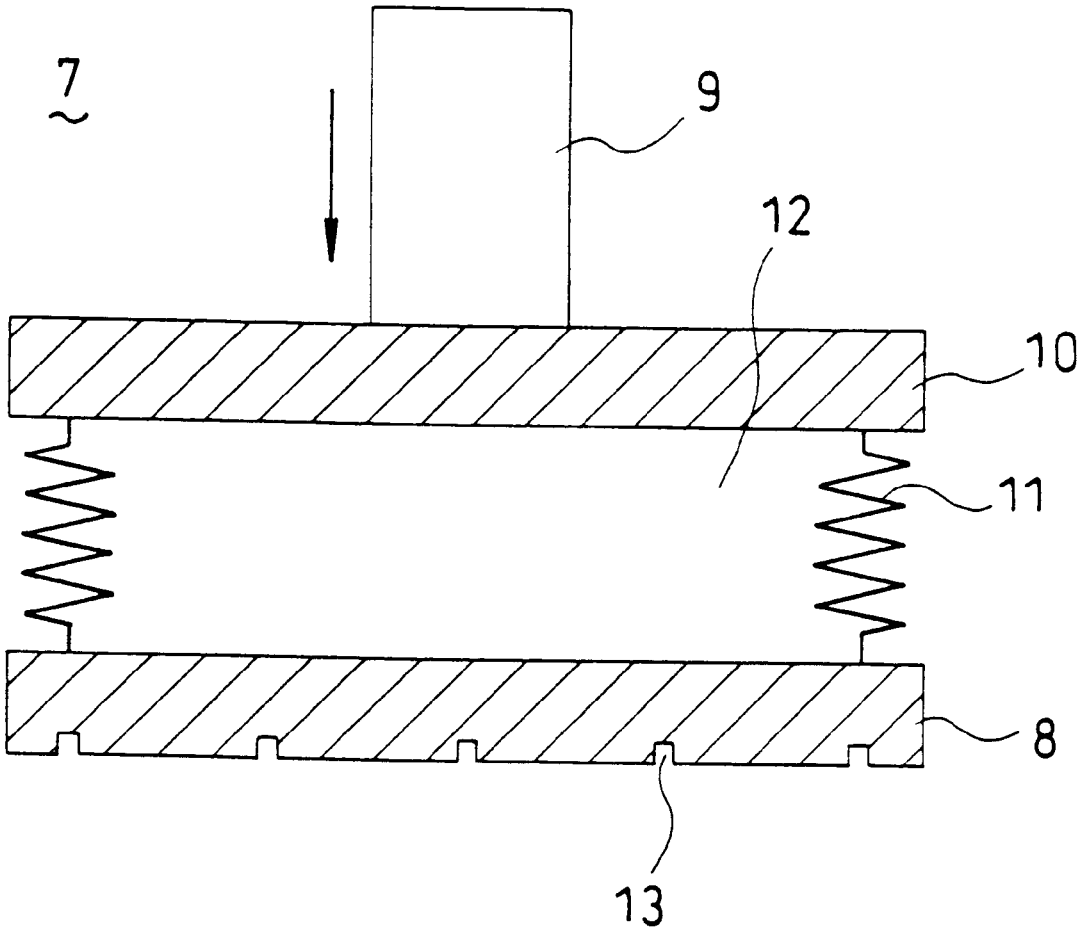
FIG. 3 is a schematic cross-sectional view of pad pressing tool in an apparatus for polishing a semiconductor substrate according to a sixth embodiment of the present invention.

FIG. 3 shows the cross-sectional construction of pad pressing means 7 of a polishing apparatus according to a sixth embodiment of the present invention.

As shown in FIG. 3, a circular plate member 10 is attached to the lower end of the rotary shaft 9 and the plate member 10 and the pad pressing plate 8 are coupled to each other by means of a flexible member 11 which can be deformed easily in the vertical direction. An airtight space 12 defined by the plate member 10, the flexible member 11, and the pad pressing plate 8 is filled with a liquid or a gas.

Even when the pad pressing plate 8 occupies a large area, the arrangement permits the pad pressing plate 8 to evenly press the polishing pad 2, resulting in equal polishing with respect to the semiconductor substrate 3.

The sixth embodiment is characterized by the provision of a large number of grooves 13 in the back face of the pad pressing plate 8. With the arrangement, even when the contact area between the pad pressing plate 8 and the polishing pad 2 is large as in the fifth embodiment, the slurry 5 is newly supplied through the grooves 13 to the surface of the polishing pad 2 at all times so that the slurry 5 is constantly present on the polishing pad 2. In this manner, the polishing agent 5 degraded by polishing the semiconductor substrate 3 can be renewed, resulting in steady polishing even when the pad pressing plate 8 is provided on the polishing pad 2.

In each of the above embodiments, the surface of the pad pressing plate in contact with the polishing pad 2 is configured flat so that the pad pressing plate will not damage the surface of the polishing pad 2.

Although the material of the pad pressing plate is not particularly limited, stable operation can be performed if the pad pressing plate is formed from resin since the slurry will not erode the pad pressing plate made of resin.

Although each of the above embodiments has described that the pressure exerted by the surface of the pad pressing plate is equal to or higher than the pressure received from the semiconductor substrate 3 under polishing, the effect of the present invention can also be expected even when the pressure exerted by the surface of the pad pressing plate is smaller than the pressure received from the semiconductor substrate 3 under polishing.

Although each of the above embodiments has described the case where the rotating platen 1 is used, similar effects can be obtained even when the platen 1 conducts a reciprocating linear movement of a circular movement.

Seventh Embodiment

Figure 4:
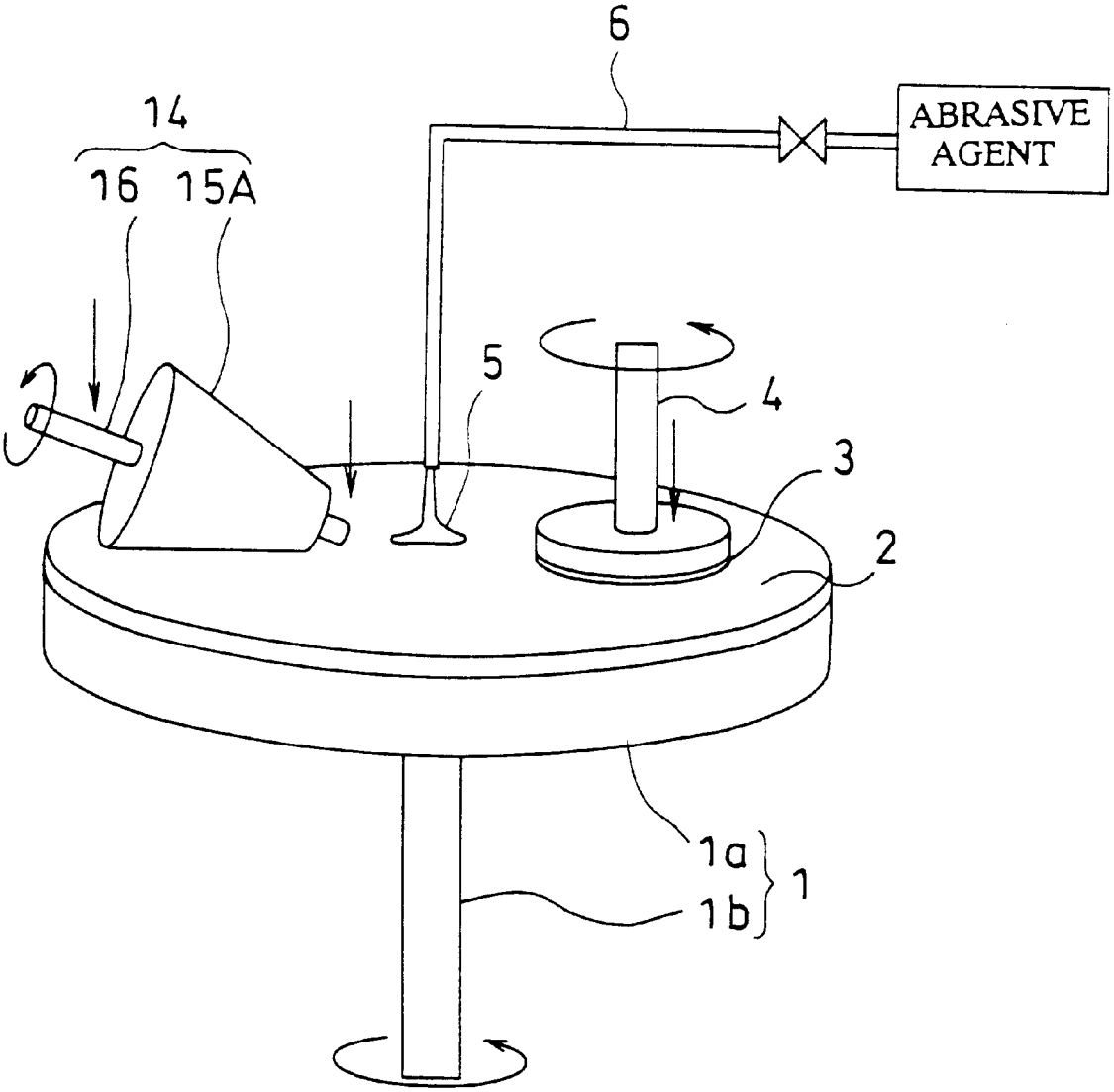
FIG. 4 is a schematic perspective view of an apparatus for polishing a semiconductor substrate according to a seventh embodiment of the present invention.

FIG. 4 is a schematic perspective view illustrating an apparatus for polishing a semiconductor substrate according to a seventh embodiment of the present invention, in which is shown a platen 1 including: a substrate holder 1*a* made of a rigid material and having a flat surface; and a rotary shaft 1b extending vertically downwardly from the back face of the above substrate holder 1*a*; and rotating means (not shown) for rotating the above rotary shaft 1*b*, substantially similarly to the first embodiment. To the top surface of the substrate holder 1*a* of the above platen 1 is adhered an elastic polishing pad 2. Above a circular first region extending from the central portion to peripheral portion of the platen 1, there is provided a substrate holding head 4 which holds and rotates a semiconductor substrate 3. The semiconductor substrate 3 is rotated and pressed against the first region of the polishing pad 2 by the substrate holding head 4. A slurry 5 is dropped in a prescribed amount from an abrasive supply pipe 6 onto the polishing pad 2 to be supplied to the space between the polishing pad 2 and the semiconductor substrate 3.

The seventh embodiment is characterized in that pad pressing means 14 for pressing a second region of the polishing pad 2 is provided above the second region extending from the central portion to peripheral portion of the platen 1. The pad pressing means 14 consists of a conical pad pressing roller 15A and a rotary shaft 16 for holding the pad pressing roller 15A.

The relative proportion of radii in respective transverse cross sections of the pad pressing roller 15A is equal to the relative proportion of distances between the center of rotation of the polishing pad 2 and respective positions thereon in contact with the respective transverse cross sections of the pad pressing roller 15A.

Below, a description will be given to the operation of the polishing apparatus according to the seventh embodiment.

First, the slurry 5 containing abrasive grains is quantitively dropped from the abrasive supply pipe 6 onto the rotating polishing pad 2 so that the slurry 5 is spread by the rotation of the platen 1 over the entire surface of the polishing pad 2.

Then, the substrate holding head 4 holding the semiconductor substrate 3 and the pad pressing means 14 are individually rotated and lowered such that the semiconductor substrate 3 and the pad pressing roller 15A are pressed against the polishing pad 2.

Figure 7A:
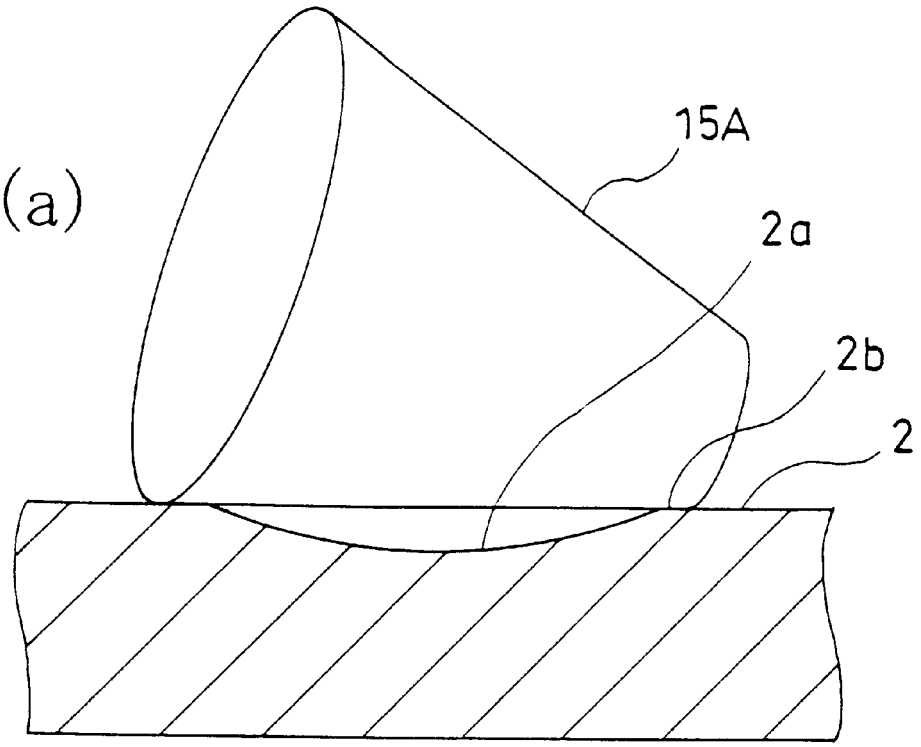
FIGS. 7(*a*) and 7(*b*) are schematic cross-sectional views illustrating elastic deformation of a polishing pad caused by pressing the polishing pad with a pad pressing roller in the apparatus for polishing a semiconductor substrate according to the seventh embodiment of the present invention.
Figure 7B:
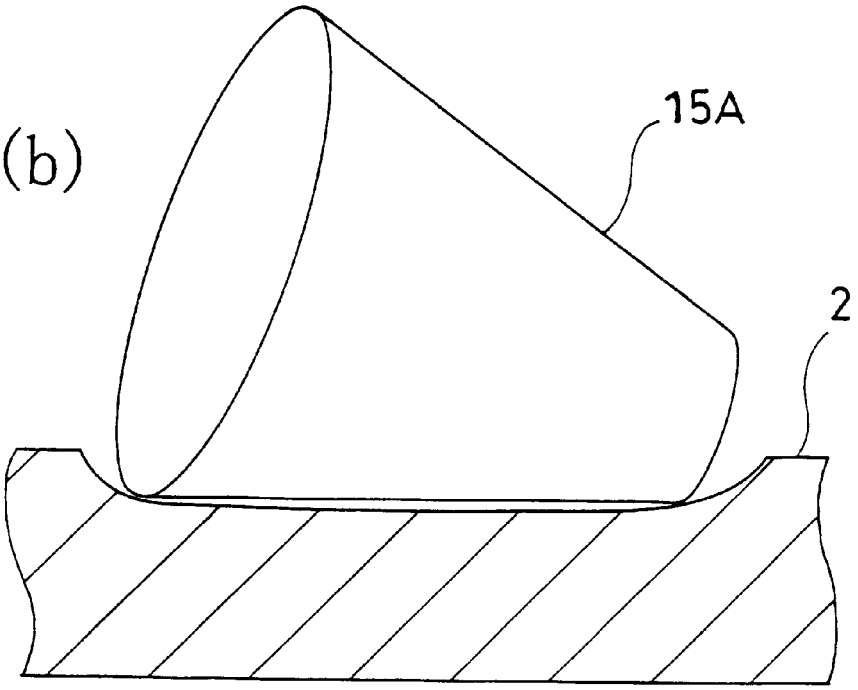
Figure 8:
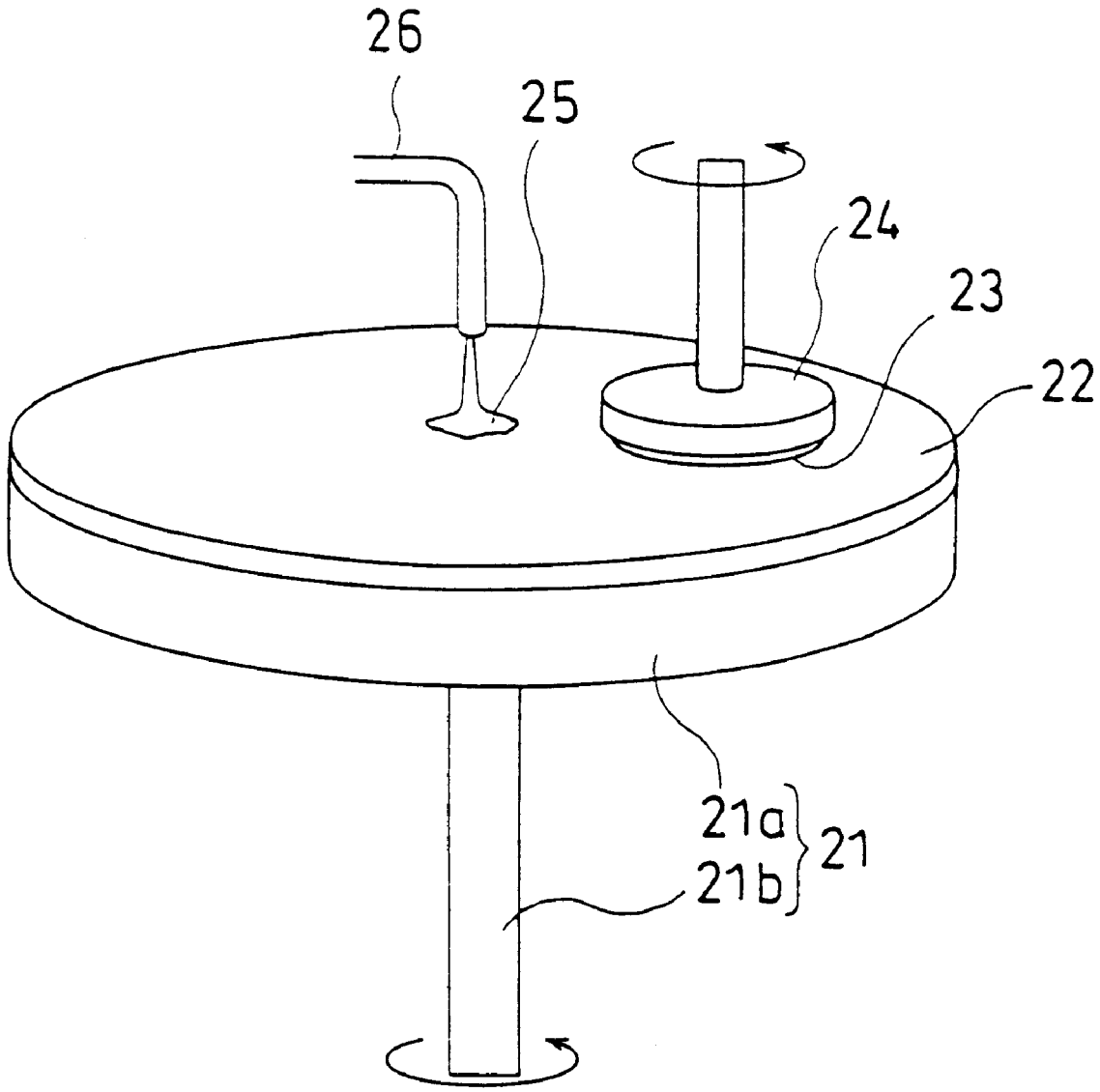
FIG. 8 PRIOR ART
FIG. 8 is a schematic perspective view of a first conventional apparatus for polishing a semiconductor substrate.
Figure 9A:
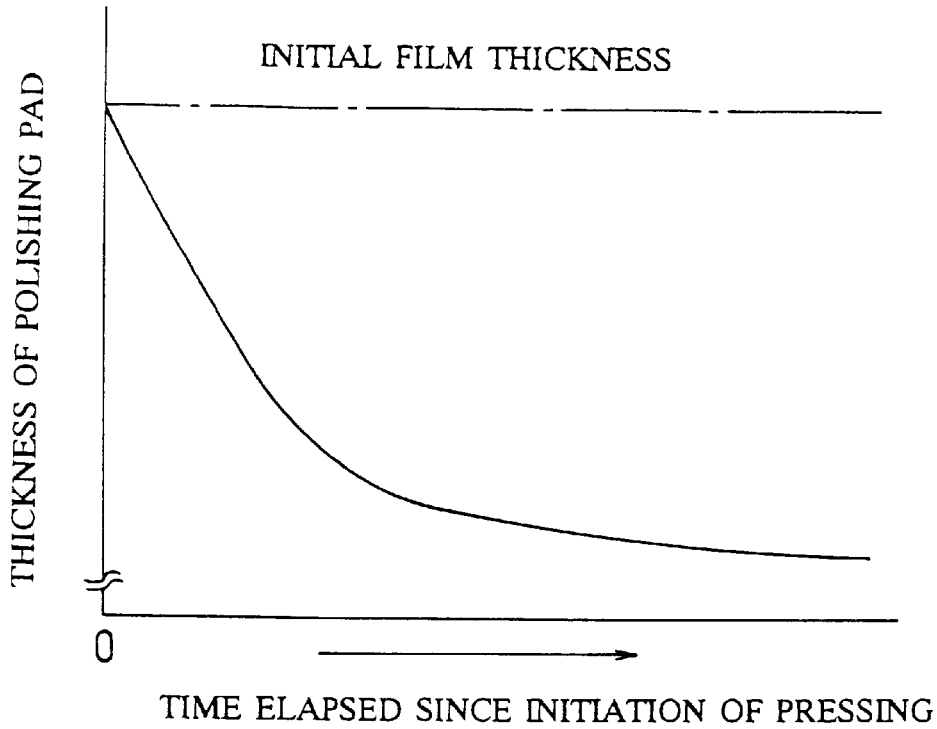
FIG. 9(a) PRIOR ART
FIG. 9(*a*) qualitatively shows a relationship between the pressing period for the polishing pad and the thickness of the polishing pad and FIG. 9(*b*) qualitatively shows a relationship between the recovering period for the polishing pad after pressing and the thickness of the polishing pad.
Figure 9B:
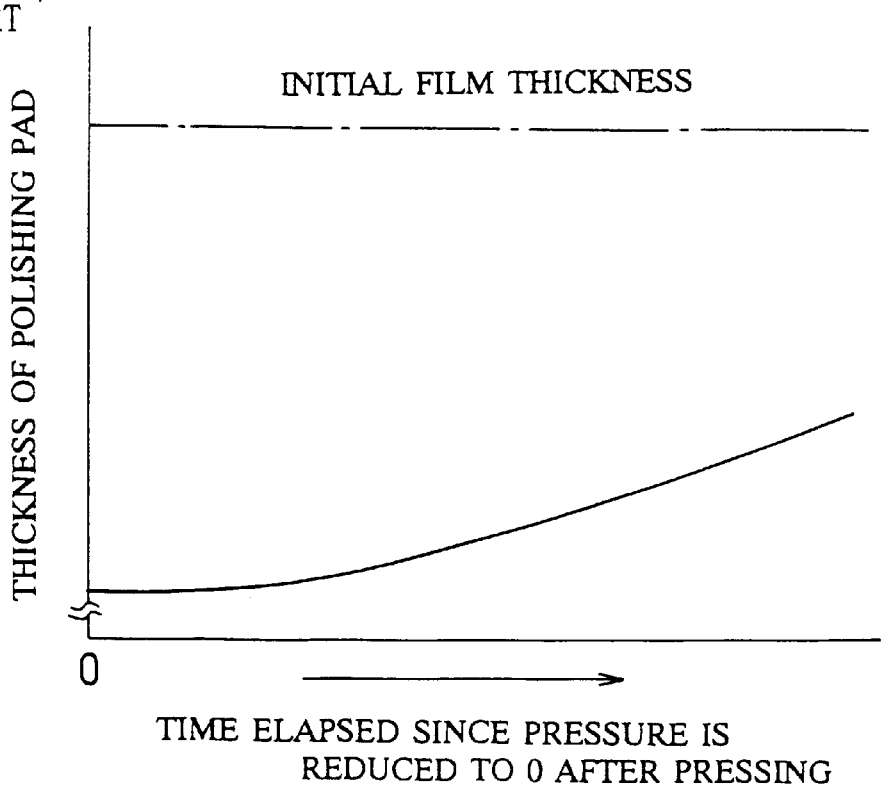
FIG. 9(b) PRIOR ART
Figure 10:
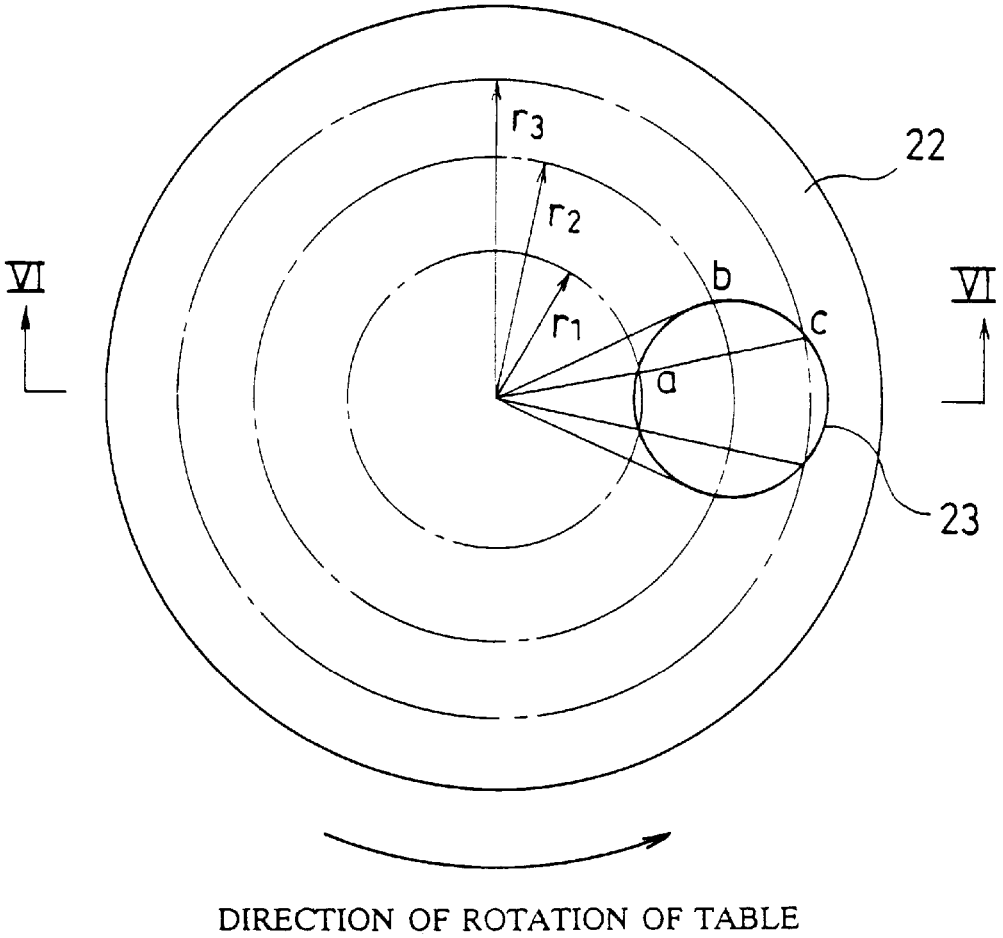
FIG. 10 PRIOR ART
FIG. 10 is a plan view illustrating different periods during which the polishing pad is in contact with and pressed by the semiconductor substrate in a conventional method and apparatus for polishing a semiconductor substrate.
Figure 11:
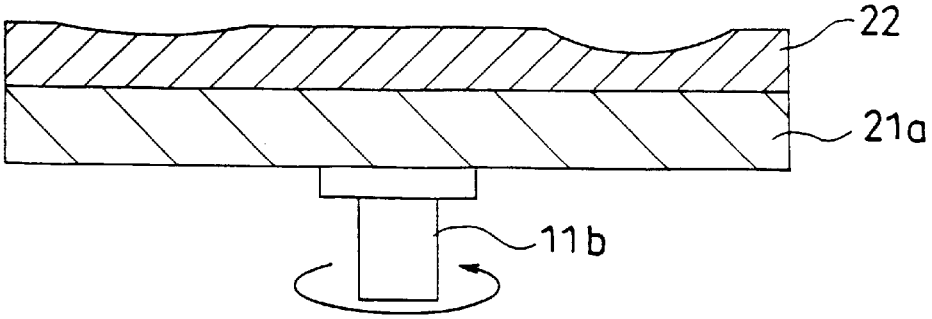
FIG. 11 PRIOR ART
FIG. 11 is a schematic cross-sectional view of the polishing pad illustrating the problems of the conventional method and apparatus for polishing a semiconductor substrate.
Figure 12:
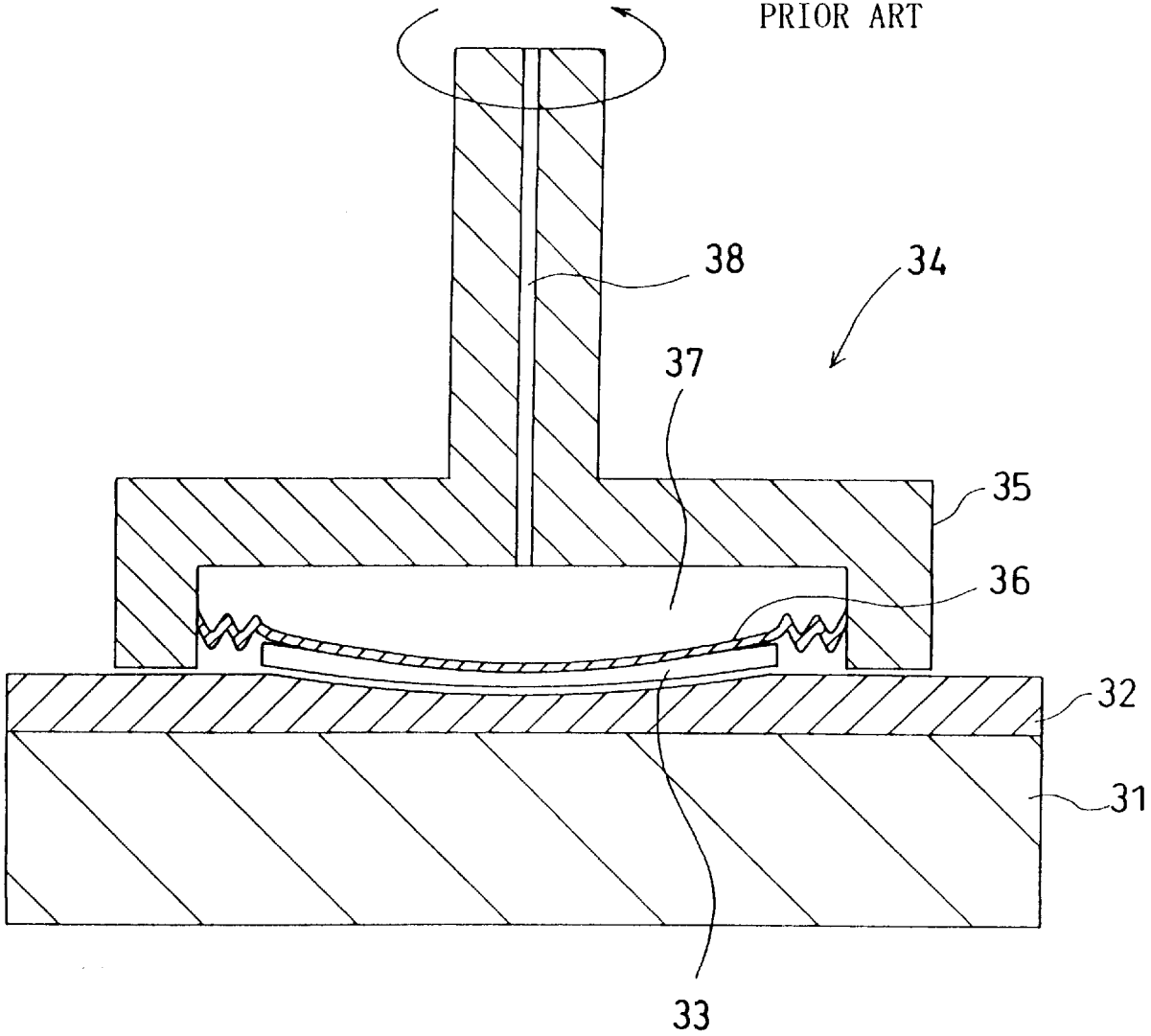
FIG. 12 PRIOR ART
FIG. 12 is a schematic cross-sectional view of a second conventional apparatus for polishing a semiconductor substrate.

FIGS. 7(*a*) and 7(*b*) are schematic cross-sectional views illustrating the polishing pad 2 pressed and elastically deformed by the pad pressing roller 15A.

As shown in FIG. 7(*a*), a recessed portion 2*a* is formed in the polishing pad 2 since the region of the polishing pad 2 in contact with the central portion of the semiconductor substrate 3 is elastically deformed to a greater degree. If the polishing pad 2 formed with the recessed portion 2*a* is pressed by the pad pressing roller 15A, a flat portion 2*b* is compressed significantly by the pad pressing roller 15A so that the first region of the polishing pad 2 is pressed and elastically deformed by the pad pressing roller 15A, resulting in a depression having a specified depth and a flat bottom face.

Since the platen 1 is rotating, the first region of the polishing pad 2 which has become the depression having a specified depth and a flat bottom face recovers instantaneously to reach the semiconductor substrate 3.

The polishing pad 2 composed of a commonly-used material containing non-woven fabric or urethane foam as the main component recovers at an extremely low speed compared with the speed at which it is elastically deformed under pressure. As long as the platen 1 is rotated at a comparatively high speed (e.g., 30 rpm or more), the amount of deformation of the polishing pad 2 remains substantially the same even after it is brought in contact with and pressed by the semiconductor substrate 3, since the polishing pad 2 has not completely recovered from elastic deformation even at the time at which the region of the polishing pad 2 compressed by the pad pressing roller 15A reaches the semiconductor substrate 3. Consequently, the second region of the polishing pad 2 compressed by the pad pressing roller 15A is still deformed when it slides over the semiconductor substrate 3.

By adjusting the amount of deformation of the polishing pad 2 at the time at which the polishing pad 2 elastically deformed by the pad pressing roller 15A reaches the semiconductor substrate 3 to a value substantially equal to the amount of deformation caused under the pressure (=the pressure exerted by the semiconductor substrate 3) during polishing, the polishing pad 2 is hardly deformed upon receiving the pressure from the semiconductor substrate 3.

Figure 5A:
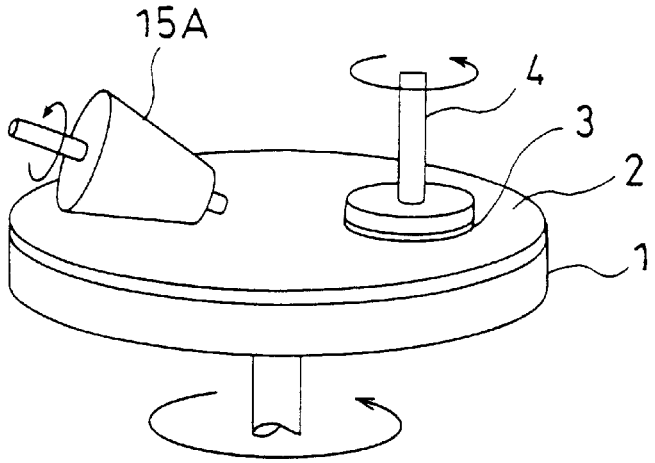
FIGS. 5(*a*) to 5(*c*) are schematic perspective views showing the respective configurations of pad pressing tools in apparatus for polishing a semiconductor substrate according to seventh to ninth embodiments of the present invention.
Figure 5B:
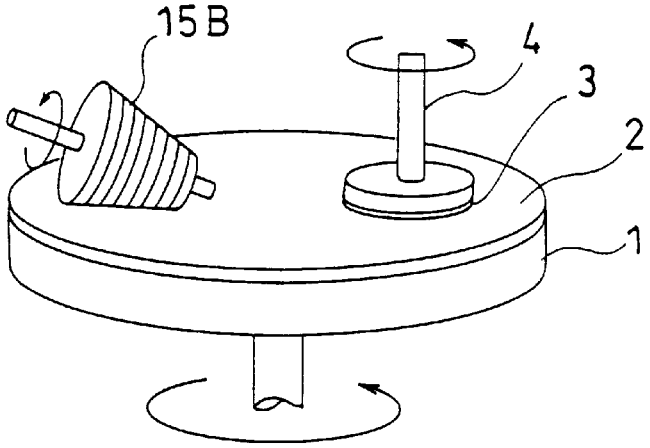
Figure 5C:
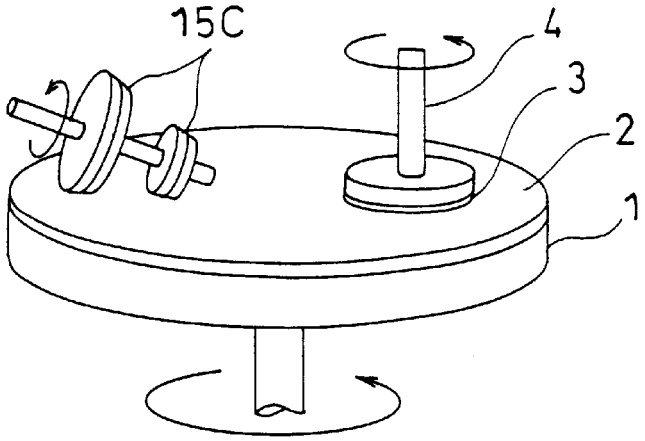

FIG. 5(*a*) shows the position of the pad pressing roller 15A relative to the polishing pad 2 in the seventh embodiment. The length of the region of the pad pressing roller 15A in contact with the polishing pad 2 is sufficiently larger than the diameter of the semiconductor substrate 3.

When the polishing pad 2 is pressed by means of the pad pressing roller 15A according to the seventh embodiment, the entire region of the polishing pad 2 in contact with the semiconductor substrate 3 is in a recovering process from elastic deformation at the time at which the polishing pad 2 reaches the semiconductor substrate 3 so that the entire region of the polishing pad 2 in contact with the semiconductor substrate 3 is still elastically deformed, which permits equal polishing with respect to the semiconductor substrate 3.

In this case, if a pressure equal to or higher than the pressure received from the semiconductor substrate 3 under polishing is exerted on the polishing pad 2 by means of the pad pressing roller 15A according to the seventh embodiment, the region of the polishing pad 2 in contact with the peripheral portion of the semiconductor substrate 3 is pressed satisfactorily and the entire region of the polishing pad 2 in contact with the semiconductor substrate 3 is elastically deformed substantially uniformly so that the region of the polishing pad 2 in contact with the peripheral portion of the semiconductor substrate 3 is also pressed satisfactorily. As a result, the entire region of the polishing pad 2 in contact with the semiconductor substrate 3 is elastically deformed substantially uniformly and the first region of the polishing pad 2 in contact with the semiconductor substrate 3 is flattened. Accordingly, the polishing pad 2 polishes the semiconductor substrate 3 under uniform pressure, resulting in equal polishing with respect to the semiconductor substrate 3.

Moreover, in the case where the platen 1 conducts a rotary movement, the pad pressing roller 15A performs rotation in accordance with the rotation speed of the platen 1 on the contact face with the polishing pad 2 by forming the pad pressing roller 15A into a truncated cone in which the relative proportion of the radii in respective cross sections of the pad pressing roller 15A is equal to the relative proportion of distances between the center of rotation of the polishing pad 2 and respective positions thereon in contact with the respective cross sections of the pad pressing roller 15A. As a result, no friction is observed on the contact face between the pad pressing roller 15A and the polishing pad 2. Thus, the use of the pad pressing roller 15A inhibits the generation of frictional heat and the polishing of the pad pressing roller 15A. Consequently, an increase in the temperature of the slurry and the deformation of the pad pressing roller 15A can be prevented, resulting in steady polishing.

Eighth Embodiment

FIG. 5(*b*) is a schematic perspective view showing the configuration of a pad pressing roller 15B of a polishing apparatus according to an eighth embodiment. In the eighth embodiment, the pad pressing roller 15B consists of a plurality of roller members each in the form of a truncated cone. The relative proportion of the radii at the respective roller members is equal to the relative proportion of the distances between the center of rotation of the polishing pad 2 and respective positions thereon in contact with the respective roller members.

If a pressure equal to the pressure received from the semiconductor substrate 3 under polishing is exerted on the polishing pad 2 by means of the pad pressing roller 15B according to the eighth embodiment, a first region of the polishing pad 2 in contact with the semiconductor substrate 3 is elastically deformed substantially more equal resulting in more equal polishing with respect to the semiconductor substrate 3.

Even when the relative proportion of the radii at the respective roller members is slightly different from the relative proportion of the distances between the center of rotation of the polishing pad 2 and respective positions thereon in contact with the respective roller members, each of the roller members performs rotation suitable for the position at which it slides over the polishing pad 2, since the individual roller members rotate independently. As a result, friction is reduced to a greater degree and more steady polishing is performed than in the seventh embodiment.

Ninth Embodiment

FIG. 5(*c*) is a schematic perspective view showing the configuration of a pad pressing roller 15C of a polishing apparatus according to a ninth embodiment. In the ninth embodiment, the pad pressing roller 15C consists of a plurality of, e.g. four, roller members each in the form of a truncated cone. The relative proportion of the radii at the respective roller members is equal to the relative proportion of the distances between the center of rotation of the polishing pad 2 and respective positions thereon in contact with the respective roller members. When four roller members constitute the pad pressing roller 15C, they are spaced in twos so as to press the regions of the polishing pad 2 in contact with the peripheral portions of the semiconductor substrate 3.

If a pressure equal to or higher than the pressure received from the semiconductor substrate 3 under polishing is exerted on the polishing pad 2 by means of the pad pressing roller 15C according to the ninth embodiment, only the region of the polishing pad 2 in contact with the peripheral portion of the semiconductor substrate 3 is pressed. By controlling the pressure of the pad pressing roller 15C to adjust the amount of deformation of the region of the polishing pad 2 in contact with the peripheral portion of the semiconductor substrate 3 to a value higher than the amount of deformation of the region of the polishing pad 2 in contact with the central portion of the semiconductor substrate 3 when the polishing pad 2 reaches the semiconductor substrate 3, a difference in pressure produced during polishing in the first region of the deformed polishing pad 2 can be reduced, resulting in more equal polishing with respect to the semiconductor substrate 3.

Although the pad pressing roller 15C has two roller members at each end portion, the number of the roller members provided at each end portion may be 1 or 3 or more. Although the outer roller members are spaced from the inner roller members, no space may be provided therebetween.

Tenth Embodiment

Figure 6A:
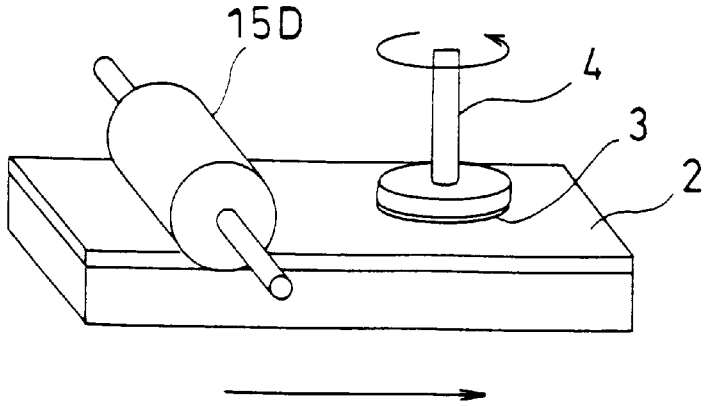
FIGS. 6(*a*) to 6(*c*) are schematic perspective views showing the respective configurations of pad pressing tools in apparatus for polishing a semiconductor substrate according to tenth to twelfth embodiments of the present invention.
Figure 6B:
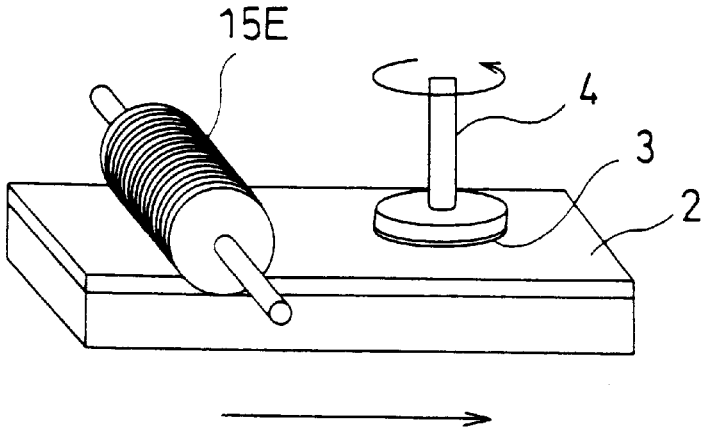
Figure 6C:
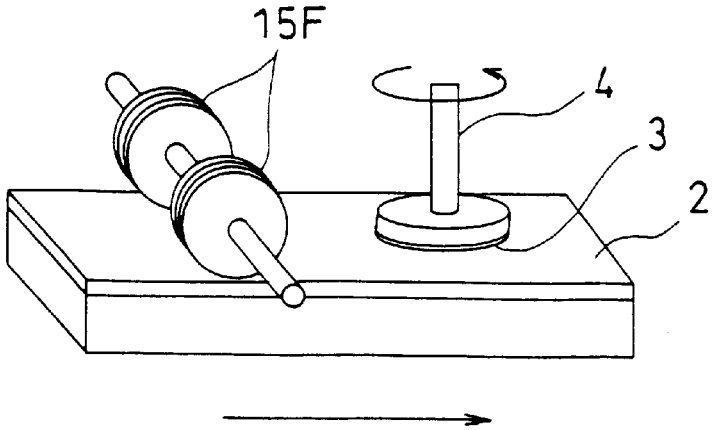

FIG. 6(*a*) is a schematic perspective view showing the configuration of a pad pressing roller 15D of a polishing apparatus according to a tenth embodiment. In the tenth embodiment, the pad pressing roller 15D is cylindrical and the platen 1 conducts a unidirectional linear movement.

When a pressure equal to or higher than the pressure received from the semiconductor substrate 3 under polishing is exerted on the polishing pad 2 by means of the pad pressing roller 15D according to the tenth embodiment, a first region of the polishing pad 2 in contact with the semiconductor substrate 3 is elastically deformed substantially uniformly, resulting in more equal polishing with respect to the semiconductor substrate 3.

In the case where the platen 1 conducts a rotary movement similarly to each of the above embodiments, the speed is different depending on the distance from the center of rotation of the platen 1, resulting in faster rotation in the outer peripheral portion and slower rotation in the central portion. When the pad pressing roller 15D integrally formed is used, the relative speeds on the contact face between the polishing pad 2 and the pad pressing roller 15D are different due to a difference in contact resistance between the pad pressing roller 15D and the polishing pad 2 since the pad pressing roller 15D rotates constantly, resulting in the generation of slight friction.

However, in the case where the platen 1 conducts a linear movement as shown in FIG. 6(*a*), the relative rate is the same on the contact face between the platen 1 and the pad pressing roller 15D, so that the use of the pad pressing roller 15D inhibits the generation of frictional heat and the polishing of the pad pressing roller 15D. Consequently, an increase in the temperature of the slurry and the deformation of the pad pressing roller 15D can be prevented, resulting in steady polishing. The cylindrical pad pressing roller 15D is also advantageous in that it can be manufactured easily.

Although the present embodiment has described the case where the linear movement of the platen 1 is unidirectional, similar effects can be achieved even when the platen 1 conducts a reciprocating linear movement. In the case where the platen 1 conducts the reciprocating linear movement, the pad pressing roller 15D is preferably provided at each end portion of the first region of the polishing pad 2 in contact with the semiconductor substrate 3.

Eleventh Embodiment

FIG. 6(*b*) is a schematic perspective view showing the configuration of a pad pressing roller 15E of a polishing apparatus according to an eleventh embodiment. In the eleventh embodiment, the pad pressing roller 15E consists of a plurality of disk-shaped roller members provided on a single shaft.

If a pressure equal to or higher than the pressure received from the semiconductor substrate 3 under polishing is exerted on the polishing pad 2 by means of the pad pressing roller 15E according to the eleventh embodiment, a first region of the polishing pad 2 in contact with the semiconductor substrate 3 is elastically deformed substantially uniformly, resulting in more equal polishing respect to the semiconductor substrate 3.

Even when the diameters of the respective roller members are slightly different from each other, each of the roller members performs suitable rotation since the individual roller members rotate independently. As a result, friction is further reduced and more steady polishing is performed than in the tenth embodiment.

In the case where the platen 1 conducts a rotary movement, the rotational speeds of the individual roller members are substantially the same as the speeds at the portions of the polishing pad 2 in contact with the roller members even when the roller members are different in distance from the center of rotation of the polishing pad 2, since the individual roller members rotate independently. Accordingly, friction can be reduced to a greater degree and more steady polishing can be performed than in the tenth embodiment.

Although the present embodiment has described the case where the platen 1 conducts a unidirectional linear movement, similar effects can be achieved even when the platen 1 conducts a reciprocating linear movement. In the case where the platen 1 conducts a reciprocating linear movement, the pad pressing roller 15E is preferably provided on each end of the first region of the polishing pad 2 in contact with the semiconductor substrate 3.

Twelfth Embodiment

FIG. 6(*c*) is a schematic perspective view showing the configuration of a pad pressing roller 15F of a polishing apparatus according to a twelfth embodiment. In the twelfth embodiment, the pad pressing roller 15F consists of a plurality of disk-shaped roller members provided on a single shaft. The plurality of roller members are positioned to press the regions of the polishing pad 2 in contact with the peripheral portions of the semiconductor substrate 3. Specifically, the pad pressing roller 15F consists of four roller members disposed in twos at both end portions of the rotary shaft.

When a pressure equal to or higher than the pressure received from the semiconductor substrate 3 under polishing is exerted on the polishing pad 2 by means of the pad pressing roller 15F according to the twelfth embodiment, only the first region of the polishing pad 2 in contact with the peripheral portion of the semiconductor substrate 3 is pressed. By controlling the pressure of the pad pressing roller 15F to adjust the amount of deformation of the region of the polishing pad 2 in contact with the outer peripheral portion of the semiconductor substrate 3 to a value larger than the amount of deformation of the region of the polishing pad 2 in contact with the central portion of the semiconductor substrate 3, a difference in the amount of deformation between the two regions of the polishing pad 2 during polishing can be reduced, resulting in more equal polishing with respect to the semiconductor substrate 3.

Even when the platen 1 conducts a rotary movement or a linear movement, each of the disks performs rotation at a speed equal to the speed of the polishing pad 2 in contact with each of the disks so that steady polishing free from friction is accomplished.

Although FIG. 6(*c*) shows the arrangement in which the pad pressing roller 15F consists of the four roller members provided in twos at both end portions of the rotary shaft, similar effects can be achieved with an arrangement in which one roller member or three or more roller members are provided at each end portion. Although the roller members provided at both end portions are spaced from each other, no space may be provided therebetween. Although the present embodiment has described the case where the platen 1 conducts a unidirectional linear movement, similar effects can be achieved even when the platen 1 conducts a reciprocating linear movement. In the case where the platen 1 conducts a reciprocating linear movement, the pad pressing roller 15F is preferably provided on each end of the first region of the polishing pad 2 in contact with the semiconductor substrate 3.

Since the surface of the foregoing pad pressing rollers 15A to 15F in contact with the polishing pad 2 is flat, it will not damage the surface of the polishing pad 2.

If the foregoing pad pressing rollers 15A to 15F are formed from resin, the pad pressing rollers 15A to 15F can perform steady operation without being eroded by the slurry.

Although it has been described that the pressure exerted by the surface of each of the foregoing pad pressing rollers 15A to 15F is equal to or higher than the pressure received from the semiconductor substrate 3 under polishing, the effect of the present invention can also be expected provided that the pressure exerted by the surface of each of the pad pressing rollers 15A to 15F is ½ or higher than the pressure received from the semiconductor substrate 3 under polishing.

We claim:

1. A method of polishing a semiconductor substrate, comprising the steps of:

supplying a slurry as an abrasive onto an elastic polishing pad disposed on a flat surface of a platen conducting a two-dimensional movement;

polishing a substantially circular semiconductor substrate by pressing said semiconductor substrate onto a correspondingly substantially circular first region of said polishing pad; and pressing a second region of said polishing pad by a pad pressing tool having a flat and smooth pressing surface so as to elastically deform said second region during polishing of said semiconductor substrate, wherein a pressure applied to said second region is higher than a pressure applied to said first region by said semiconductor substrate.

2. The method of polishing a semiconductor substrate according to claim 1, wherein said flat and smooth pressing surface of said pad pressing tool is circular or annular.

* * * * *